US005685436A

United States Patent [19]

Davet

[11] Patent Number: 5,685,436

[45] Date of Patent: Nov. 11, 1997

[54] DISPLAY DEVICE

[76] Inventor: Peter A. Davet, 14250 Sweetbriar La., Novelty, Ohio 44072

[21] Appl. No.: 580,815

[22] Filed: Dec. 29, 1995

[51] Int. Cl.[6] ..... A47F 7/00

[52] U.S. Cl. ..... 211/13; 211/163

[58] Field of Search ..... 211/13, 163, 129, 211/131, 144, 78, 4; 206/6.1

[56] References Cited

U.S. PATENT DOCUMENTS

| | | | |
|---|---|---|---|
| 3,204,774 | 9/1965 | Barbieri | 211/4 |
| 4,040,520 | 8/1977 | Jonquin | 211/13 |
| 4,074,637 | 2/1978 | Lorenzen, Jr. | 109/38 |
| 4,120,401 | 10/1978 | Newman | 206/566 |
| 4,157,760 | 6/1979 | Wilson | 211/13 |
| 4,180,169 | 12/1979 | Michels | 211/13 |
| 4,300,674 | 11/1981 | Davet | 206/45 |
| 4,511,041 | 4/1985 | Waitzman | 206/566 |
| 4,632,351 | 12/1986 | Coon | 248/309 |
| 5,379,903 | 1/1995 | Smith | 211/13 |

*Primary Examiner*—Alvin C. Chin-Shue
*Assistant Examiner*—Sarah L. Purol
*Attorney, Agent, or Firm*—D. Peter Hochberg; Mark Kusner

[57] ABSTRACT

A display device for manually liftable small articles. The display device secures the articles in a manner which allows for close examination and which prevents their theft or loss. The display device does not require modification or alteration of the articles.

21 Claims, 8 Drawing Sheets

DISPLAY DEVICE

FIELD OF THE INVENTION

The present invention relates generally to a display device, and more particularly to a display device for small manually liftable articles.

BACKGROUND OF THE INVENTION

A merchandiser or collector of small manually liftable articles (e.g., rings, jewelry and the like) will often have the need to display those articles for various purposes. One method of display is to provide photographs of the articles. However, this method does not permit a prospective customer an opportunity to thoroughly analyze or handle the articles. Another method of display is to provide actual samples of the articles, and allow a prospective customer to closely examine and handle the articles. However, this approach may pose a problem with respect to possible theft by unscrupulous individuals, or to an accidental loss of the articles by carelessness on the part of the merchandiser or the prospective customer.

Prior art display devices have been designed which allow close examination and handling of the articles. However, these prior art display devices have had several drawbacks. Some display devices fail to provide a simple and convenient means for safely returning the articles to the display device after they have been examined. Other display devices require that the articles be physically altered for use with the display.

It should be appreciated that where a jewelry item, such as a ring, is soldered onto the shank of the ring to attach to a tether, the individual item will no longer be saleable. Where large numbers of jewelry items are displayed on a single display device, a substantial cost may be incurred due to the inability to sell the altered or modified jewelry items. For instance, where 36 styles are displayed on a display device, and each jewelry item has an average retail price of $50, $1,800 in sales could be lost.

Furthermore, it has been found that allowing a perspective customer to touch and try on an article will greatly enhance sales. When articles, such as jewelry, are inside an enclosed display, sales have been known to drop dramatically.

The present invention overcomes these and other drawbacks of prior art display devices.

SUMMARY OF THE INVENTION

According to the present invention, there is provided a display device for manually liftable articles. The display device is comprised of a plurality of support means located generally transverse to each other, article holding means disposed on each of the support means, and tether means. The article holding means includes receptacle means for holding an article. The tether means is operatively connected to the article holding means, and includes a reel means and a holding line. The reel means is biased to reel the holding line onto the reel means. The holding line includes a retaining means for retaining an article on the holding line. The reel means withdraws the holding line and moves the article to the receptacle means when the person releases the article.

It is an object of the present invention to provide a display device for manually liftable articles that does not require physical alteration of the articles for secure display thereof.

It is still another object of the present invention to provide a display device for manually liftable articles, wherein the articles can be removed from the display device for close examination and handling, and which has a convenient and simple arrangement for safely returning the articles to the display device.

It is still another object of the present invention to provide a display device for manually liftable articles which prevents the theft or loss of the articles.

It is yet another object of the present invention to provide a display device for manually liftable articles which is long-lasting, durable and easily refurbished after repeated use.

It is yet another object of the present invention to provide a display device particularly suitable for the display of rings and like jewelry.

These and other objects will become apparent from the following description of preferred embodiments of the present invention, taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF THE PREFERRED EMBODIMENT

Figure 4:
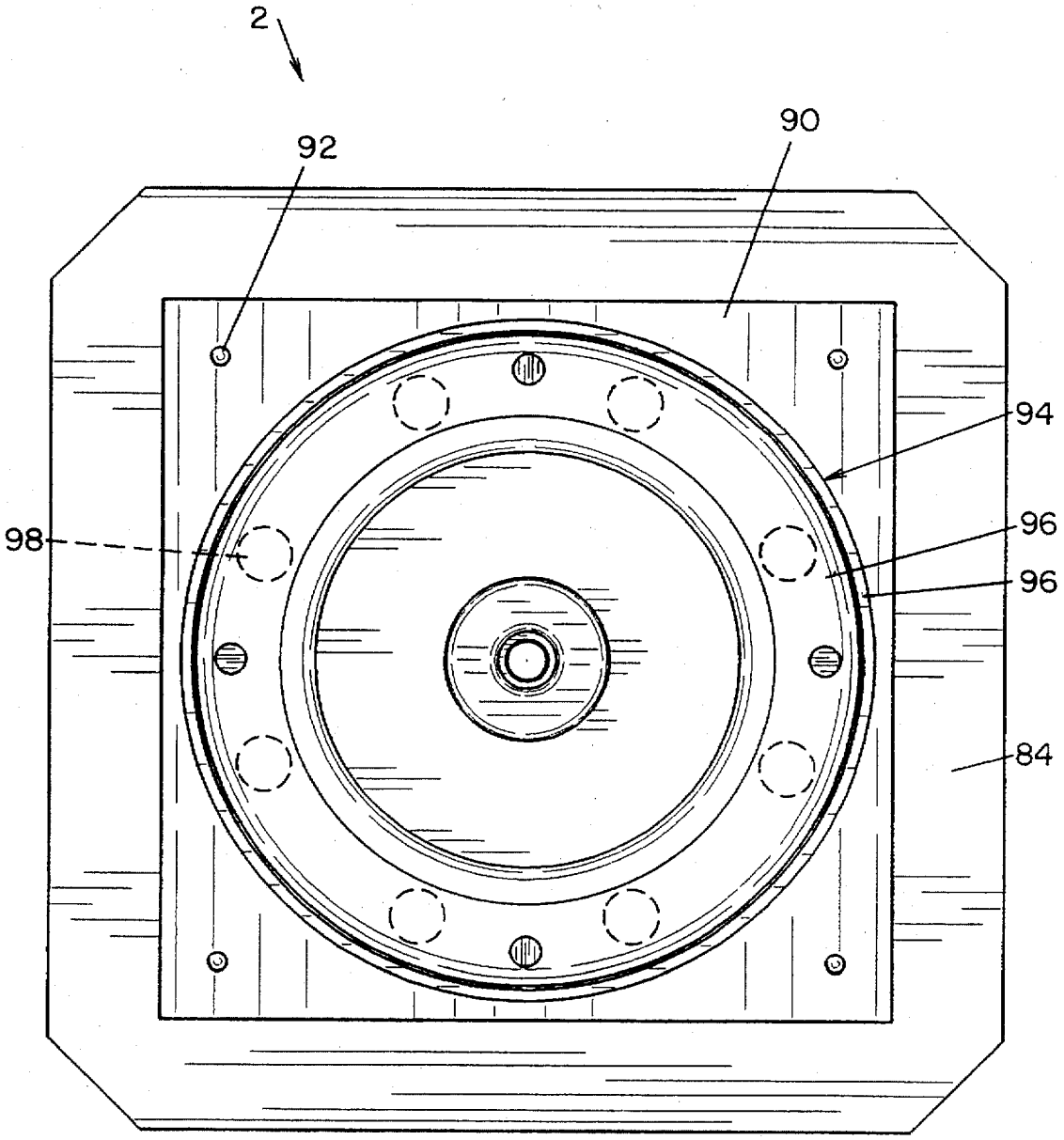
FIG. 4 is a bottom view of the display device shown in FIG. 1.
Figure 5:
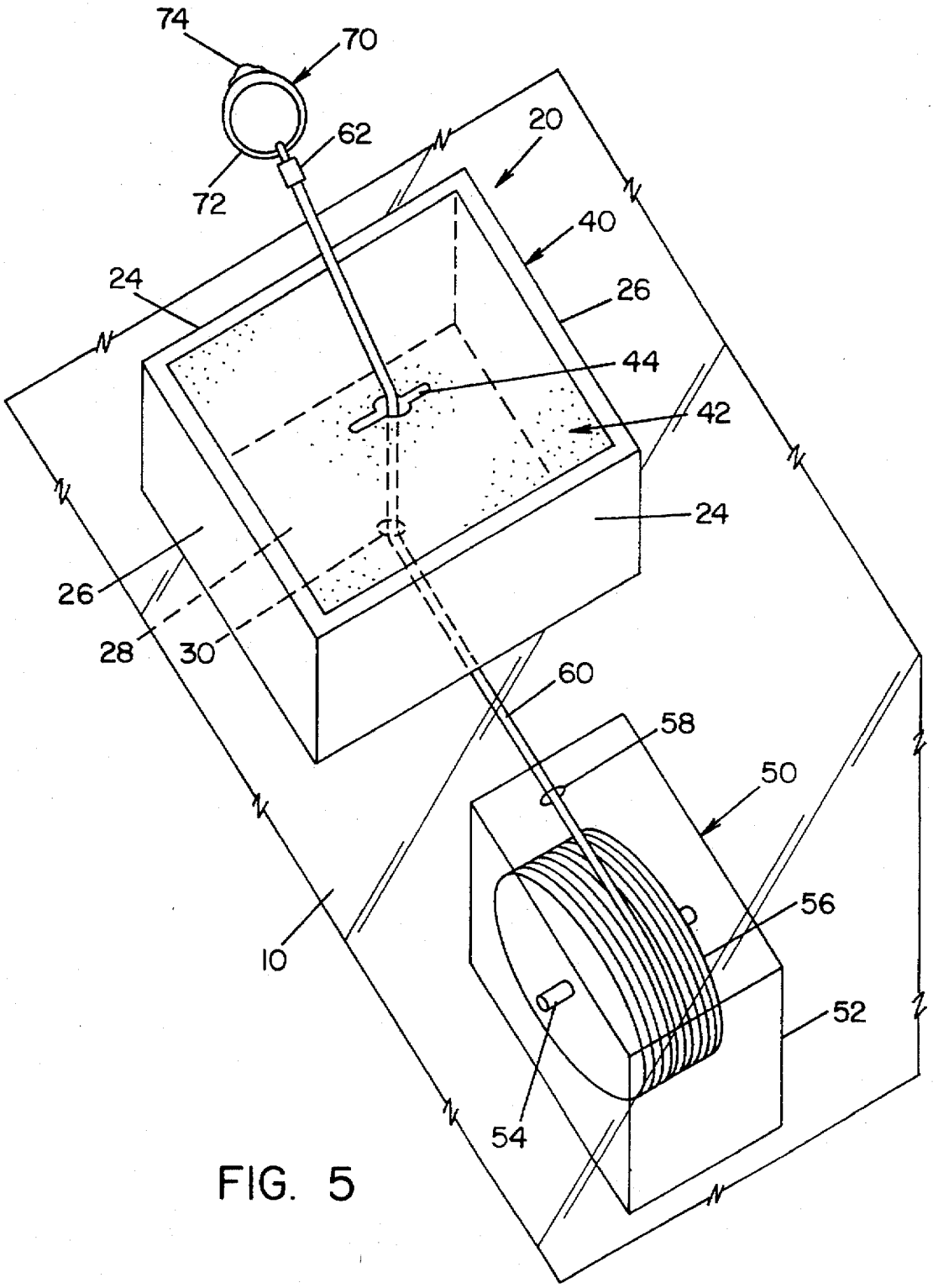
FIG. 5 an enlarged perspective view of an article holding member of the display device shown in FIG. 1.

Referring now to the drawings wherein the showing is for the purpose of illustrating preferred embodiments of the invention only, and not for the purpose of limiting same, FIGS. 1–5 shows a display device 2 according to a preferred embodiment of the present invention. Display device 2 is generally comprised of support members 10, article holding members 20, and tether means 50 (FIG. 5). Support members 10 are generally planar sheets having a front face and a rear face. In the embodiment shown in FIGS. 1–5, support members 10 are arranged transverse to each other to form a truncated pyramid. It should be appreciated that a pyramidal shape allows for a large number of articles to be displayed within a small area. The interior angle between the plane of one support member 10 and a horizontal plane transversing the plane of the one support member 10 is preferably between 30° and 90°. This orientation helps to impede collection of dust on support members 10 and the articles arranged thereon. Support members 10 are preferably constructed of a planar acrylic sheet.

Article holding members 20 are mountable to the front face of support members 10, as discussed below.

Alternatively, article holding members 20 may be formed integral with support members 10. Article holding members 20 may be arranged in any number of configurations along the front face of support members 10. Injection molded acrylic is the preferred material for article holding members 20.

It should be noted that support members 10 may include an article information area 12 adjacent to each article holding member 20. Labels may be applied to article information area 12 to identify and/or describe the articles arranged in the respective adjacent article holding members 20. For instance, labels may provide code numbers, product descriptions, and prices for the articles.

Figure 1:
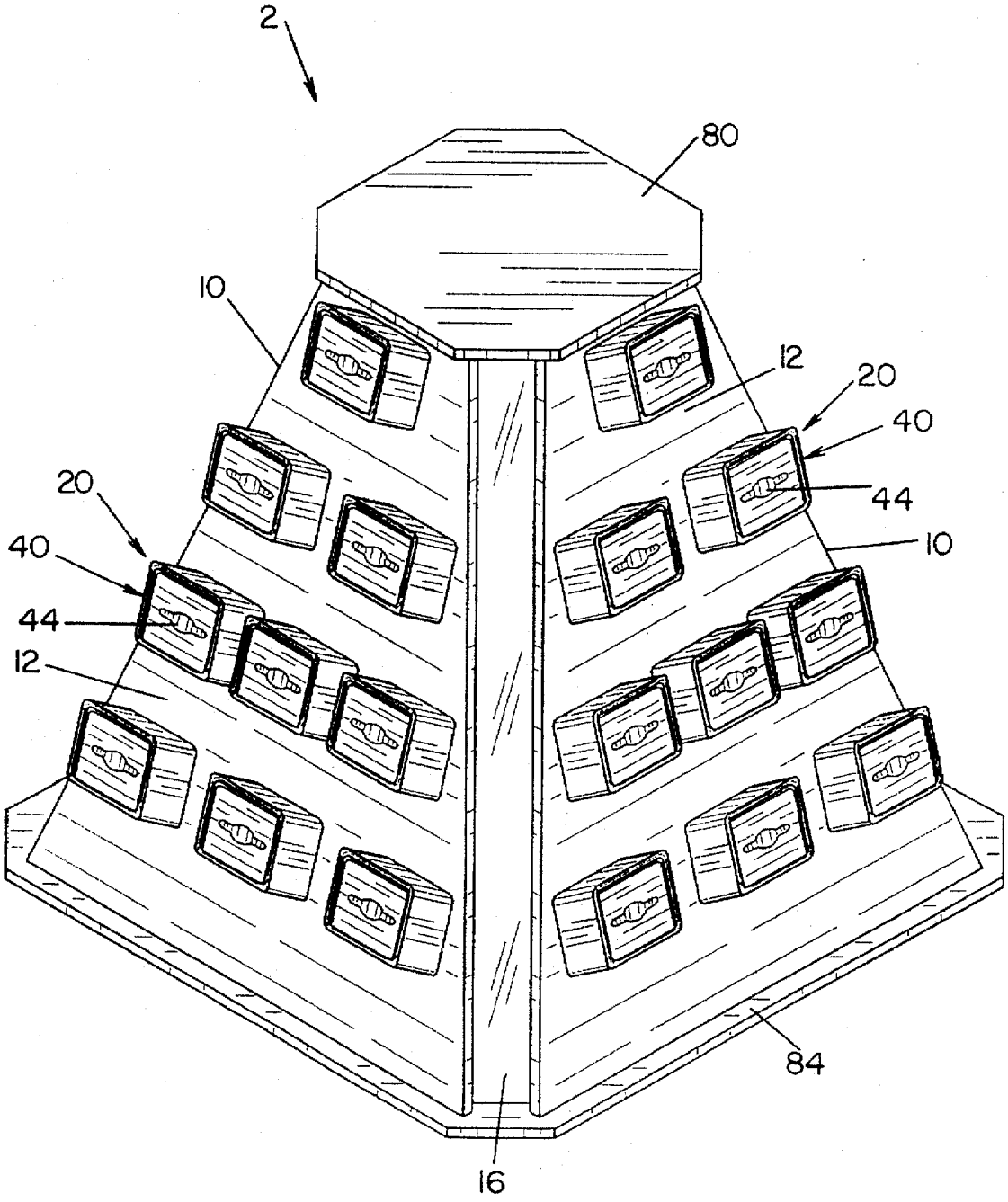
FIG. 1 is a perspective view of a display device illustrating a preferred embodiment of the present invention.
Figure 2:
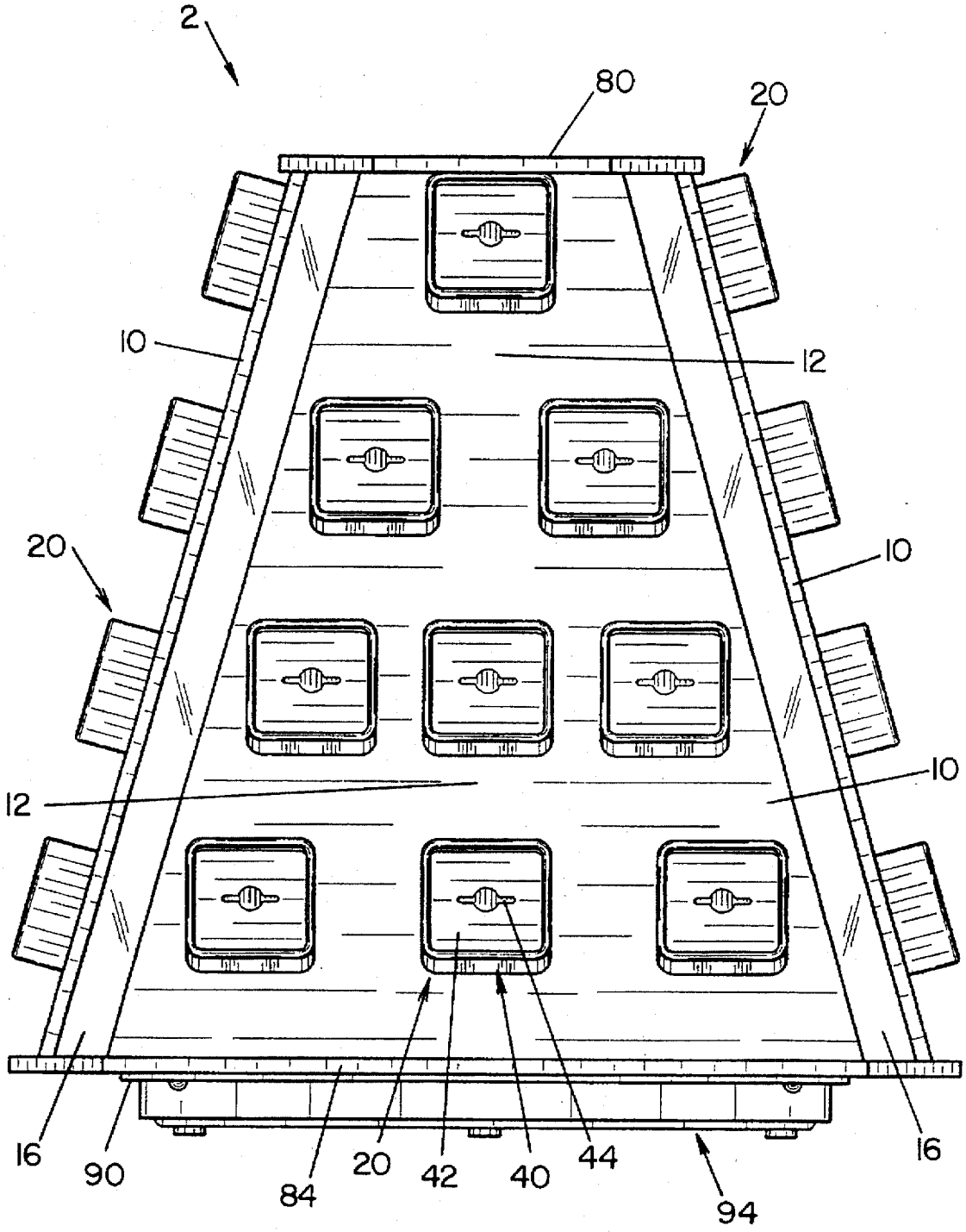
FIG. 2 is a side perspective view of the display device shown in FIG. 1.
Figure 3:
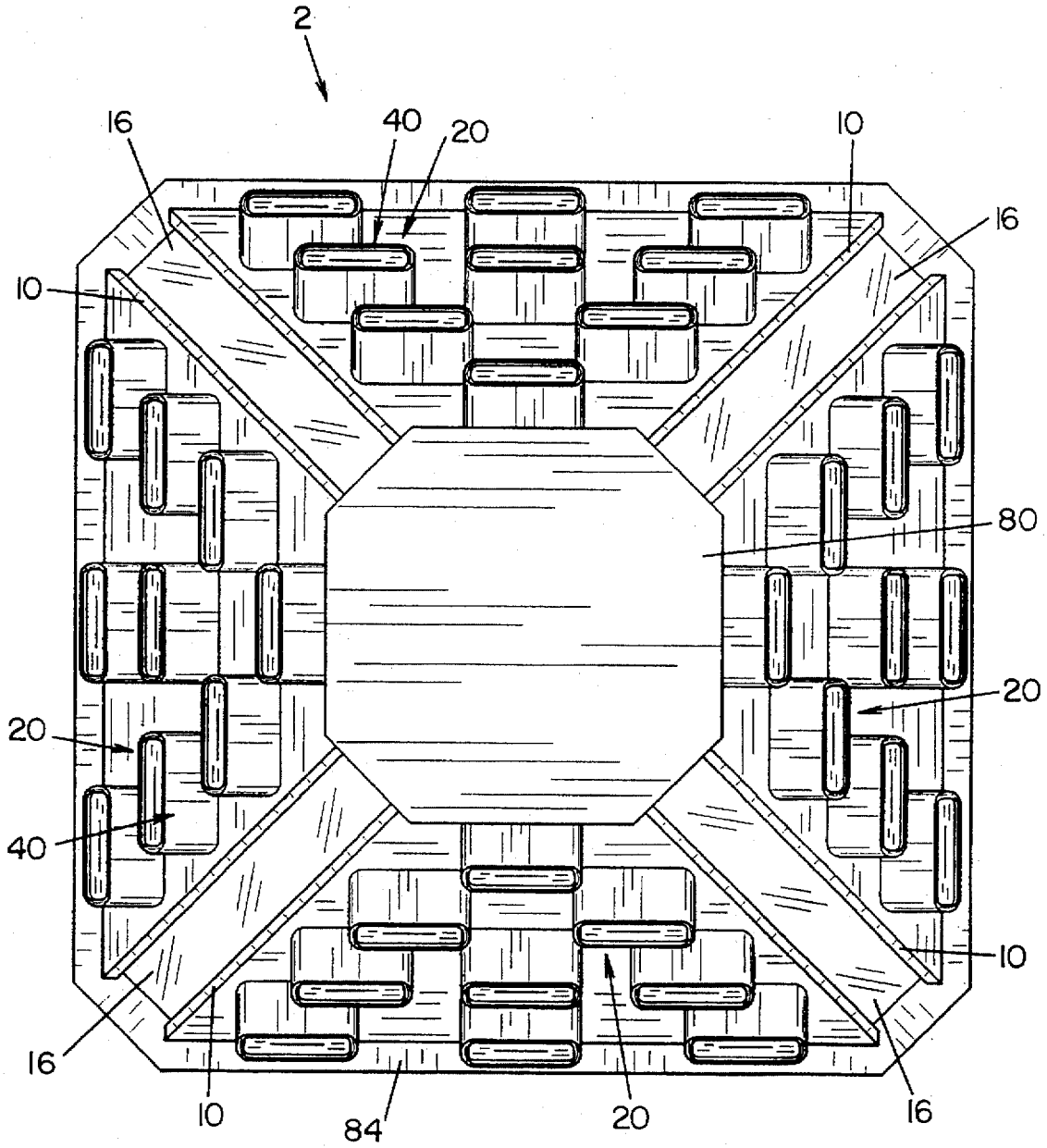
FIG. 3 is a top perspective view of the display device shown in FIG. 1.

A plurality of mirror sections 16 are located between adjacent support members 10. Mirror sections 16 allow a prospective customer to examine the article in a mirror. A generally planar lid member 80 is fixed to the upper edge of support members 10. A generally planar base member 84 is fixed to the lower edge of support members 10, as best seen in FIGS. 1 and 2. Base member 84 includes an opening (not shown) for providing access to the rear face of support member 10.

With reference to FIG. 4, a removable panel 90 is operatively connected to base member 84. Removable panel 90 covers the opening in base member 84. In a preferred embodiment of the present invention, a plurality of fasteners 92 (e.g., screws) are used to operatively connect removable panel 90 to base member 84. Removal of panel 90 allows the rear face of support members 10 to be accessed through the opening in base member 84.

Rotation means 94 is arranged on removable panel 90. Rotation means 94 is generally comprised of a pair of support plates 96 and ball bearing means 98. Ball bearing means 98 are arranged between said pair of support plates 96. One support plate 96 is fixed to removable panel 90, while the other support plate 96 supports display device 2 upon a generally horizontal surface. Ball bearing means 98 allow the two support plates 96 to rotate relative to each other. Accordingly, display device 2 is rotatable about its vertical axis.

Referring now to FIG. 5, there is shown an enlarged perspective view of article holding members 20 and tether means 50. Article holding members 20 are generally comprised of a pair of side walls 24 and a pair of end walls 26. Article holding members 20 are mounted to the front face of support members 10, preferably by use of an acrylic fix. Accordingly, support members 10 provide a floor 28. An opening 30 is formed in floor 28 for receiving a holding line 60 of tether means 50. Tether means 50 will be described in greater detail below.

A receptacle 40 is defined by side walls 24, end walls 26 and floor 28. Receptacle 40 provides a raised platform or "nesting box", and is dimensioned to receive a manually liftable article, such as a ring. Preferably, receptacle 40 is formed of injection molded plastic. It should be appreciated that receptacle 40 may also take the form of a triangle or other shape.

An insert member 42 is arranged within receptacle 40. In this respect, insert member 42 may include an adhesive for adhering insert member 42 to floor 28 of receptacle 40. A locating aperture 44 is formed in insert member 42 for locating the manually liftable article within receptacle 40 and for receiving holding line 60 of tether means 50, as will be described below. Locating aperture 44 is preferably formed by die cutting, rather than slitting, to prevent the article from becoming stuck therein.

Insert member 42 is preferably comprised of a foam material for cushioning the article within receptacle 40. The foam is easily replaceable after repeated use to provide a clean "new" looking display device. A felt lining may also be provided on the surface of insert member 42 facing outward from receptacle 40. The felt lining improves the appearance of the article resting on it. Moreover, the felt lining extends the life of the foam by preventing it from becoming soiled and torn. Accordingly, the felt lining preserves and protects the foam.

Tether means 50 is arranged on the rear face of support members 10 opposite article holding members 20 (FIG. 5). It will be appreciated that tether means 50 may be attached to the rear face of support means 20 by the use of an adhesive. Accordingly, tether means 50 may be easily removed for repair or replacement.

Tether means 50 is generally comprised of a housing 52, a reel 56 and a holding line 60. Housing 52 includes an axle 54, about which reel 56 rotates. Reel 56 is located inside housing 52 and is spring-loaded. Holding line 60 is wound around reel 56. To unwind holding line 60 the force of the spring loading reel 56 must be overcome. Housing 52 prevents holding line 60 from jumping off reel 56.

Holding line 60 has a fixed end and a free end. The fixed end of holding line 60 is fixed to reel 56. The free end of holding line 60 is attachable to a manually liftable article 70 (FIG. 5). In this respect, holding line 60 is extended through opening 58 in housing 52, opening 30 in floor 28 and through locating aperture 44 of insert member 42. Holding line 60 is then looped through an opening in article 70 and crimped with a retaining member 62 to form a closed loop. Importantly, article 70 is not physically altered to connect it with holding line 60. Therefore, article 70 may be used upon removal from holding line 60. Retaining member 62 has a larger diameter than opening 58 in housing 52. Therefore, retaining member 62 prevents holding line 60 from being completely withdrawn onto reel 56 before holding line 60 is attached to an article. It should be appreciated that retaining member 62 may take the form of a double-barrelled fastener.

Referring now to FIG. 5, article 70 takes the form of a ring having a shank portion 72 and an ornamental portion 74. Holding line 60 forms a closed loop around shank portion 72. Upon release of article 70, spring-loaded reel 56 will wind holding line 60 thereabout, thus automatically retracting holding line 60 and bringing at least part of shank portion 72 into locating aperture 44 of receptacle 40. Ornamental portion 74 will extend outward of locating aperture 44. Holding line 60 is preferably comprised of a nylon coated stainless steel braided cable. This material is difficult to cut, thus making it difficult to remove article 70 from holding line 60.

It should be appreciated that tether means 50 may also include a braking device for slowing the winding of holding line 60 upon reel 56.

Figure 6:
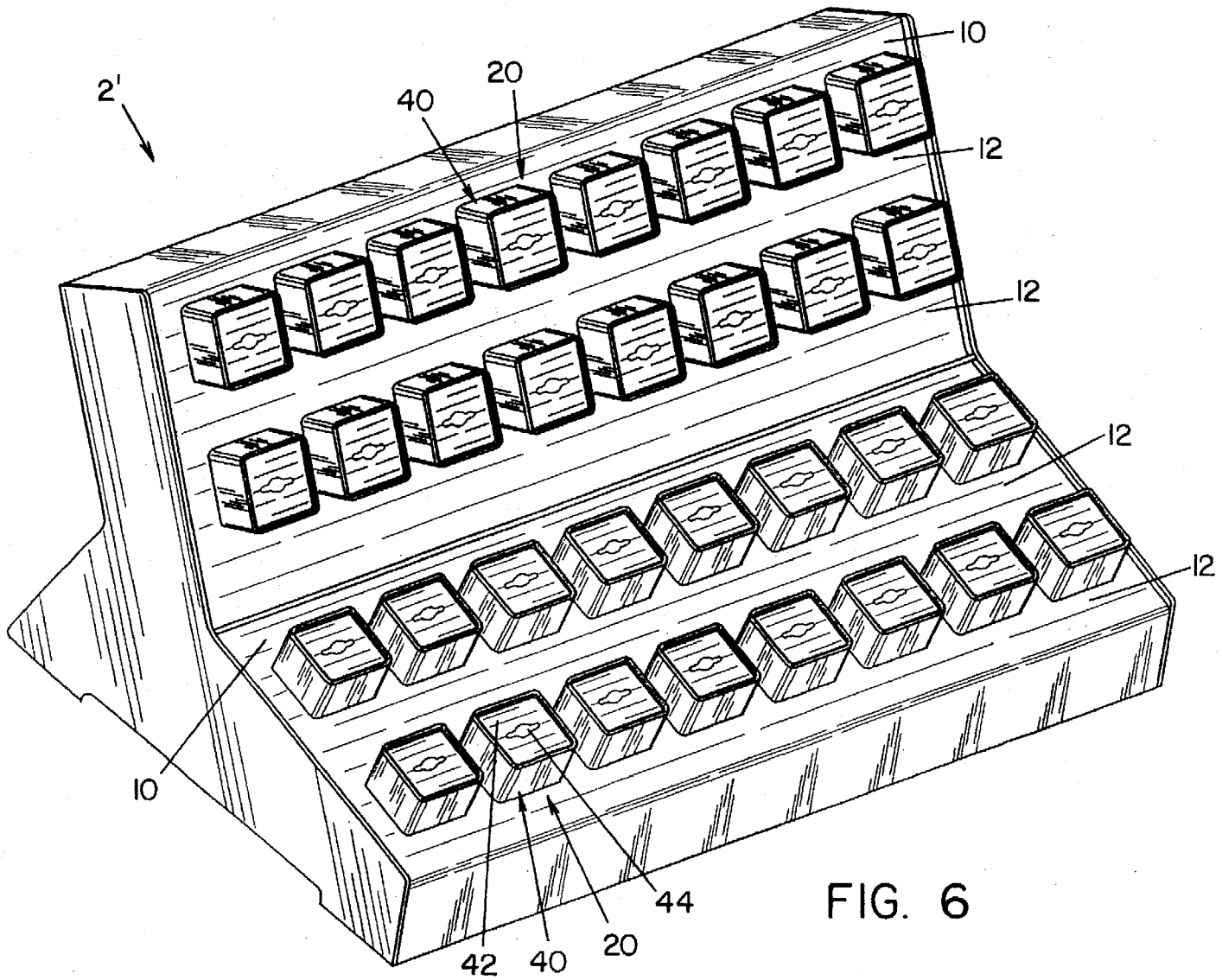
FIG. 6 is a perspective view of a display device illustrating another embodiment of the present invention.
Figure 7:
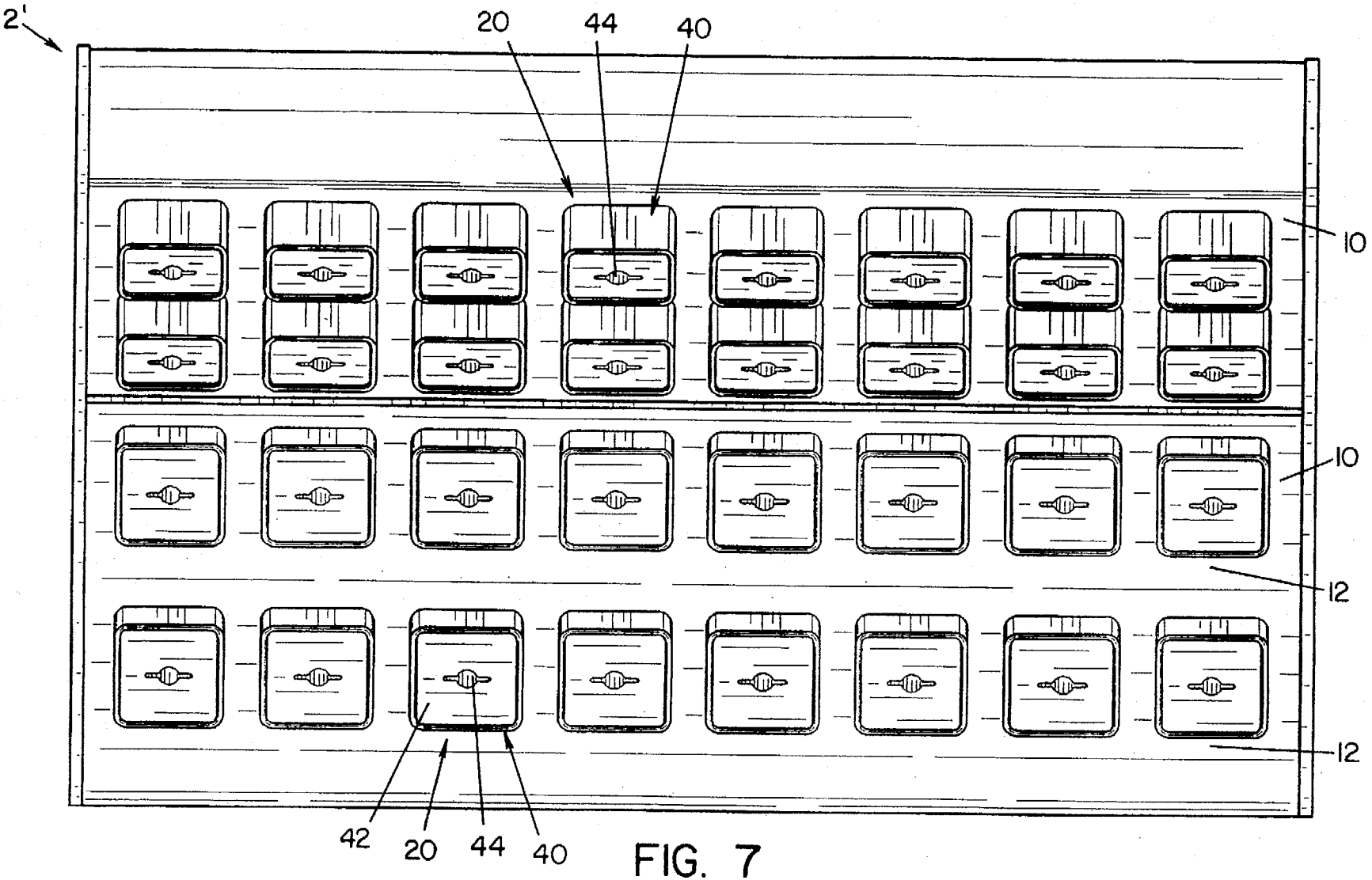
FIG. 7 is a top view of the display device shown in FIG. 6.
Figure 8:
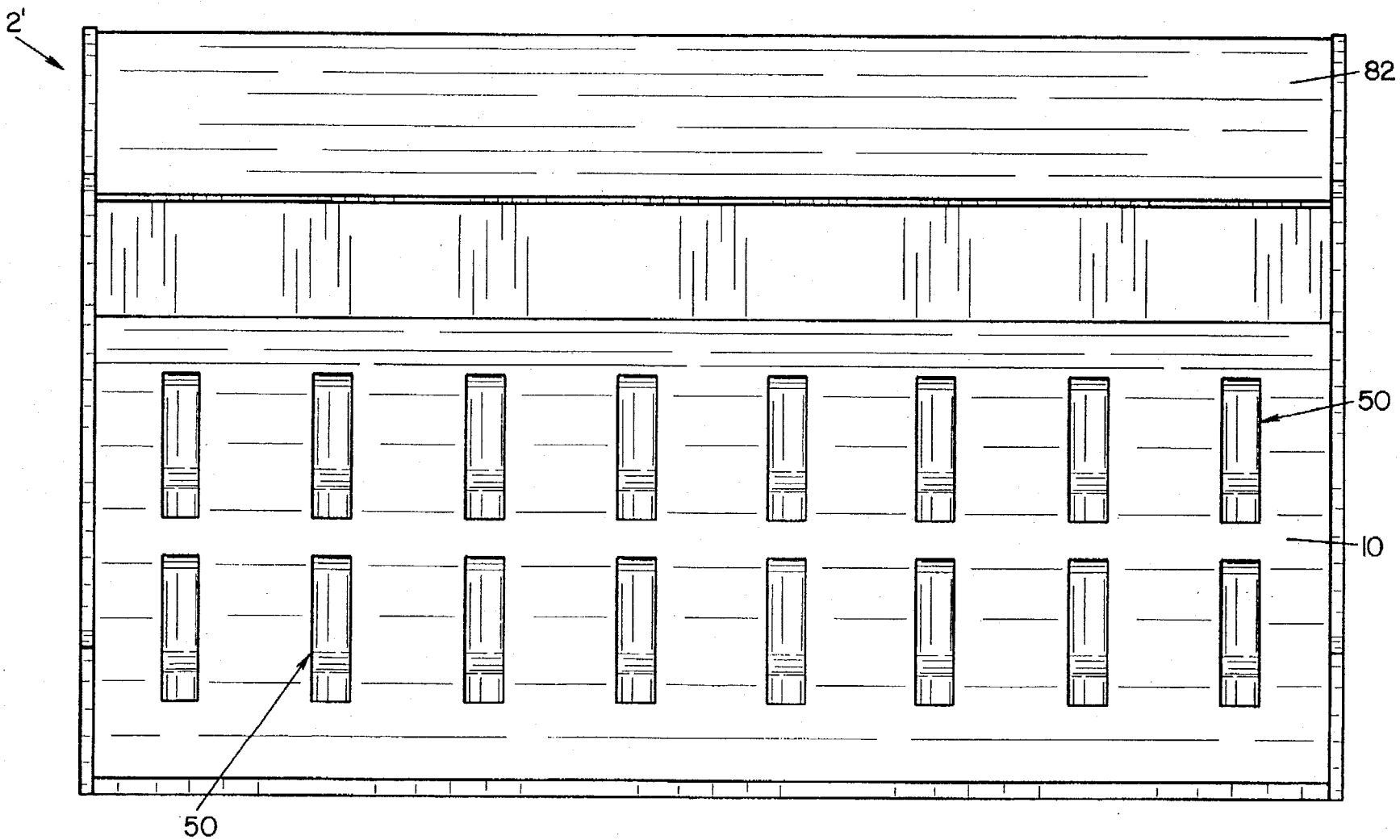
FIG. 8 is a bottom view of the display device shown in FIG. 6.

Referring now to FIGS. 6–8, an alternative embodiment of display device 2 is shown. Support members 10 are at an angle of approximately 130° to 140° relative to each other to form a "bench." In this embodiment, display device 2' includes removable panels 82 (FIG. 8). Removable panels 82 are preferably held in place by magnets (not shown). Magnets allow panels 82 to be quickly and easily removed from display device 2'. By removing panels 82, tether means 50, which are adhered to the rear face of support members 20, can be accessed for installation, replacement or repair. In FIG. 8, a lower removable panel 82 has been removed to allow access to tether means 50.

Display device 2 and 2' are used in the following manner. An article 70 is operatively connected to holding line 60, as discussed above. A person desiring to closely examine or try on the article can pull the article out from locating aperture 44. As a result, holding line 60 will unreel from reel 56 and be extended out from receptacle 40. When a person has completed their examination of the article, they may release it. When article 70 is released, holding line 60 is automatically retracted onto reel 56. Accordingly, article 70 returns to receptacle 40.

The foregoing description is directed to specific embodiments of the present invention. It should be appreciated that these embodiments are described for purposes of illustration only, and that numerous alterations and modifications may be practiced by those skilled in the art without departing from the spirit and scope of the invention. For instance, the display device may have numerous different shapes than those discussed herein, and may be constructed of wood, metal or other materials. It is intended that all such modifications and alterations be included insofar as they come within the scope of the invention as claimed or the equivalents thereof.

Having described the invention, the following is claimed:

1. A display device for manually liftable articles, said display device comprising:

a plurality of support means located generally transverse to each other;

article holding means disposed on each of said support means, said article holding means including receptacle means for holding an article; and tether means operatively connected to said article holding means, said tether means including a reel means and a holding line, said reel means being biased to reel said holding line onto said reel means, the holding line including a retaining means for retaining an article on said holding line, said retaining means cooperating with said holding means for releasably holding the article on said tether means without physically altering the article to enable use of the article once released from said holding means, the article being manually liftable for use or examination by a person, said reel means withdrawing said holding line and moving the article to said receptacle means when the person releases the article.

2. A display device according to claim 1, wherein said holding line is comprised of a metal.

3. A display device according to claim 2, wherein said holding line is comprised of a nylon coated stainless steel cable.

4. A display device according to claim 1, wherein said retaining means is a crimping member for attaching the article to said holding line.

5. A display device according to claim 1, wherein said reel means comprises a spring-biased reel disposed in a housing for preventing said holding line from straying from said reel.

6. A display device according to claim 1, wherein said support means comprises at least one generally planar acrylic sheet, and said receptacle means is integral with said at least one acrylic sheet.

7. A display device according to claim 1, wherein said plurality of support means form a truncated pyramid.

8. A display device according to claim 1, wherein the angle between at least two of said support means is between approximately 130° and 140°.

9. A display device according to claim 1, wherein said article holding means further comprises cushion means located within said receptacle means to cushion an article in said receptacle means.

10. A display device according to claim 9, wherein said cushion means includes a felt lining.

11. A display device according to claim 1, wherein said display device further comprises article information means adjacent said article holding means to describe the article located in the respective receptacle means.

12. A display device according to claim 1, wherein said display device further comprises a base member fixed to said plurality of support means, and rotating means connected to said base member for allowing rotation of said display device about its vertical axis.

13. A display device according to claim 1, wherein the interior angle between the plane of at least one support means and a horizontal plane transversing said plane of said at least one support means is between 30° and 90° to impede the collection of dust on said support means and the articles displayed by said display means.

14. A display device according to claim 1, wherein said display device further includes at least one mirror located adjacent to one of said support means.

15. A display device for manually liftable articles, said display device comprising:

a plurality of support means located generally transverse to each other;

article holding means disposed on each of said support means, said article holding means including receptacle means for holding an article;

tether means operatively connected to said article holding means, said tether means including a reel means and a holding line, said reel means being biased to reel said holding line onto said reel means, the holding line including a retaining means for retaining an article on said holding line, the article being manually liftable for use or examination by a person, said reel means withdrawing said holding line and moving the article to said receptacle means when the person releases the article; and a removable panel arranged at the lower edge of said plurality of support means, said panel removable to provide access to said reel means.

16. A display device according to claim 1, wherein said reel means are removable and replaceable.

17. A display device according to claim 1, wherein said articles are rings having a shank portion and an ornamental portion, said receptacle means including a locating structure for receiving at least part of the shank portion, but exposing the ornamental portion.

18. A display device according to claim 1, wherein each said support means is a support member having a front face and a rear face, said reel means located adjacent said rear face.

19. A display device according to claim 18, wherein said display device further comprises panel means for blocking access to said rear faces of said support members.

20. A display device according to claim 19, wherein said panel means are removable from said display device.

21. A display device for manually liftable articles, said display device comprising:

a plurality of support means located generally transverse to each other, wherein each said support means is a support member having a front face and a rear face, said reel means located adjacent said rear face;

article holding means disposed on each of said support means, said article holding means including receptacle means for holding an article; and tether means operatively connected to said article holding means, said tether means including a reel means and a holding line, said reel means begin biased to reel said holding line onto said reel means, the holding line including a retaining means for retaining an article on said holding line, the article being manually liftable for use or examination by a person, said reel means withdrawing said holding line and moving the article to said receptacle means when the person releases the article;

wherein said display device further comprises panel means for blocking access to said rear faces of said support members; said removable panel means being removable from said display device and including magnetic means for removably holding said removable panel means on said display device.

* * * * *